US006175193B1

(12) United States Patent
Kishita et al.

(10) Patent No.: US 6,175,193 B1
(45) Date of Patent: Jan. 16, 2001

(54) ELECTROLUMINESCENT DISPLAY DEVICE

(75) Inventors: Hiroyuki Kishita, Kariya; Masahiko Osada, Hekinan; Koji Ogusu; Takashi Hanaki, both of Kariya; Naoki Matsumoto, Aichi-gun, all of (JP)

(73) Assignee: Denso Corporation, Kariya (JP)

( * ) Notice: Under 35 U.S.C. 154(b), the term of this patent shall be extended for 0 days.

(21) Appl. No.: 09/538,267

(22) Filed: Mar. 30, 2000

(30) Foreign Application Priority Data

Mar. 31, 1999 (JP) ..... 11-092130

(51) Int. Cl.[7] ..... G09G 3/10

(52) U.S. Cl. ..... 315/169.3; 315/169.1; 315/169.2; 345/76; 345/79; 345/204; 345/208; 345/209

(58) Field of Search ..... 315/169.1, 169.2, 315/169.3, 307, 360; 345/76, 79, 95, 204, 208, 209

(56) References Cited

U.S. PATENT DOCUMENTS 4,864,182 * 9/1989 Fujioka et al. ..... 315/169.3
4,999,618 * 3/1991 Inada et al. ..... 345/79
5,006,838 * 4/1991 Fujioka et al. ..... 345/79
5,847,516 * 12/1998 Kishita et al. ..... 315/169.3
5,973,456 * 10/1999 Osada et al. ..... 315/169.1
6,064,158 * 5/2000 Kishita et al. ..... 315/169.3

FOREIGN PATENT DOCUMENTS 1307797 12/1989 (JP) .

* cited by examiner

*Primary Examiner*—Haissa Philogene
(74) *Attorney, Agent, or Firm*—Law Office of David G. Posz

(57) ABSTRACT

A flat display panel having electroluminescent layer and scanning and data electrodes is driven by driving circuits connected to the respective electrodes. Scanning voltages are sequentially supplied to the scanning electrodes one by one, and data voltages are supplied to the data electrodes in synchronism with the scanning voltages, thereby selectively imposing composite voltages on pixels formed at each intersection of the scanning and data electrodes. The pixels on one scanning electrode that is already scanned are charged to a level of a data modulation voltage to prevent a harmful and useless turnaround current from flowing into the scanned pixels when other scanning electrodes are scanned. The pixels on other scanning electrodes that are not yet scanned may be charged to the modulation voltage level at the same time the scanned pixels are charged. Since the turnaround current is thus eliminated, uneven brightness among scanning electrodes otherwise appearing on the display panel is suppressed.

11 Claims, 7 Drawing Sheets

ELECTROLUMINESCENT DISPLAY DEVICE

CROSS-REFERENCE TO RELATED APPLICATION

This application is based upon and claims benefit of priority of Japanese Patent Application No. Hei-11-92130 filed on Mar. 31, 1999, the content of which is incorporated herein by reference.

BACKGROUND OF THE INVENTION

1. Field of the Invention

The present invention relates to a display device having a display panel in which capacitive luminescent elements such as electroluminescent elements are used.

2. Description of Related Art

An example of a circuit for driving an electroluminescent display panel is disclosed in U.S. Pat. No. 5,847,516. In this example, an electroluminescent panel having scanning and data electrodes and pixels arranged in a matrix is driven by scanning and data electrode driving circuits. The display panel is sequentially scanned with a positive voltage in a positive field and with a negative voltage in a negative field. Specifically, in the positive field, a scanning voltage Vr is sequentially supplied to the scanning electrodes and an offset voltage that is the same as a modulation voltage Vm is used as a base voltage. A ground voltage Vg is supplied to pixels to be activated and a modulation voltage Vm is supplied to the pixels not to be activated from the data electrodes. In the negative field, a scanning voltage −(Vr−Vm) is sequentially supplied to the scanning electrodes and the ground voltage Vg is used as a base voltage. The modulation voltage Vm is supplied to pixels to be activated and the ground voltage Vg is supplied to the pixels not to be activated from the data electrodes.

The pixels on which voltage Vr is imposed emit light, while the pixels on which voltage (Vr−Vm) is imposed do not emit light. Thus, the pixels arranged in a matrix are selectively activated thereby to display images on the panel. After scanning on the scanning electrodes is completed, electric charges stored in the pixels connected to the scanned electrodes are discharged.

However, there is a following problem in the conventional device disclosed. Since the charges stored in the scanned pixels are discharged when the fields are switched and after the scanning of a selected scanning electrode is completed, a turnaround current is supplied to the scanned pixels when other scanning electrodes are scanned thereafter. That is, since the base voltage of each scanning electrode is set to the voltage Vm that is the same as the modulation voltage in the positive field, the discharged pixels are charged with Vm when the data electrode voltage becomes the ground level voltage Vg (Vg is zero volt). The base voltage of each scanning electrode is set to the ground voltage Vg in the negative field. Therefore, the discharged pixels are charged with the modulation voltage Vm when the data electrode voltage becomes Vm. The turnaround current flowing in this manner does not contribute to luminescence of the pixels, and accordingly this turnaround current is useless and only increases power consumption.

Further, since the turnaround current flows when the data voltage becomes a level to activate the pixels, driving voltage waveforms are deformed or distorted especially when output current for driving the pixels is low, thereby causing uneven brightness among pixels. Such a waveform deformation or distortion is caused by changes of driving voltages and data voltages. For example, when the scanning voltages (Vr and Vm in the positive field, and −(Vr−Vm) and Vg in the negative field) are supplied from a common power source circuit in both fields, the offset voltage Vm is decreased by the turnaround current due to resistance between the scanning electrode driving circuit and the power source circuit in the positive filed, and the ground voltage Vg is increased in the negative field. In accordance with those voltage changes, the voltages Vr and −(Vr−Vm) also change, making the driving voltage insufficient to activate the pixels. Especially, when a scanning electrode having many pixels to be activated is scanned after a series of scanning of electrodes having no pixels to be activated, the amount of the turnaround current becomes large, and thereby the driving voltages Vr and −(Vr−Vm) change in a high degree. In addition to the driving voltage changes, the data voltage waveforms are also changed by the turnaround current, thereby causing the uneven brightness mentioned above. The degree of the uneven brightness becomes especially large when it is required to make a pulse width narrow for a stepwise control of brightness, because a sufficient voltage cannot be imposed on the pixels on a selected scanning electrode.

SUMMARY OF THE INVENTION

The present invention has been made in view of the above-mentioned problem, and an object of the present invention is to provide an improved display device, in which unnecessary turnaround current is suppressed in scanning of a display panel and thereby to prevent uneven brightness among pixels.

A display device includes a flat display panel having a luminescent layer such as an electroluminescent layer, an array of scanning electrodes disposed on one surface of the luminescent layer, and another array of data electrodes disposed on the other surface of the luminescent layer. Both electrode arrays are arranged to perpendicularly cross each other. Pixels arranged in a matrix are formed at each intersection of the scanning and data electrodes together with the luminescent layer. A scanning electrode driving circuit is connected to the scanning electrodes to supply scanning voltages thereto, and a data electrode driving circuit is connected to the data electrodes to supply data voltages thereto.

The scanning electrodes are sequentially scanned, e.g., from the top of the display panel toward the bottom thereof, and composite voltages consisting of the scanning and data voltages are supplied to the pixels thereby to selectively activate the pixels to emit light therefrom. The scanning and data voltages may be supplied from both ends of the respective electrodes to quickly activate the pixels. The scanning is performed by supplying positive scanning voltages in a positive field and negative scanning voltages in a negative field, both fields being consecutively alternated.

After the scanning of one scanning electrode is completed, electric charges stored in the pixels on the scanned electrode are discharged. The discharged pixels are charged again to a level of a data voltage modulation voltage by supplying a turnaround current thereto before the scanning moves to the next scanning electrode. When other scanning electrodes are scanned, a harmful and useless turnaround current is prevented from flowing into the pixels on the electrode already scanned, because the already scanned pixels are charged to the level of the modulation voltage. Since the turnaround current is eliminated in this manner, driving voltages imposed on all the pixels are stabilized, and thereby uneven brightness among the scanning electrodes is suppressed. Moreover, less power is consumed for driving the display panel because the useless turnaround current is eliminated.

The pixels on other scanning electrodes that are not yet scanned may be charged with the modulation voltage at the same time the scanned pixels are charged. Further, all the pixels may be preliminarily charged to the level of the modulation voltage before the first scanning electrode in each field is scanned. In this manner, the effect of suppressing the uneven brightness is further enhanced.

Alternatively, electric charges stored in the pixels on the scanned electrode are transferred to the pixels on other scanning electrodes that are not yet scanned. All the pixels including the scanned pixels are equally charged to the level of the modulation voltage, thereby eliminating the turnaround current. This can be done by bringing all the data electrodes to a high impedance state after scanning of one scanning electrode is completed and before the scanning moves to the next scanning electrode.

DETAILED DESCRIPTION OF THE PREFERRED EMBODIMENTS

Figure 1:
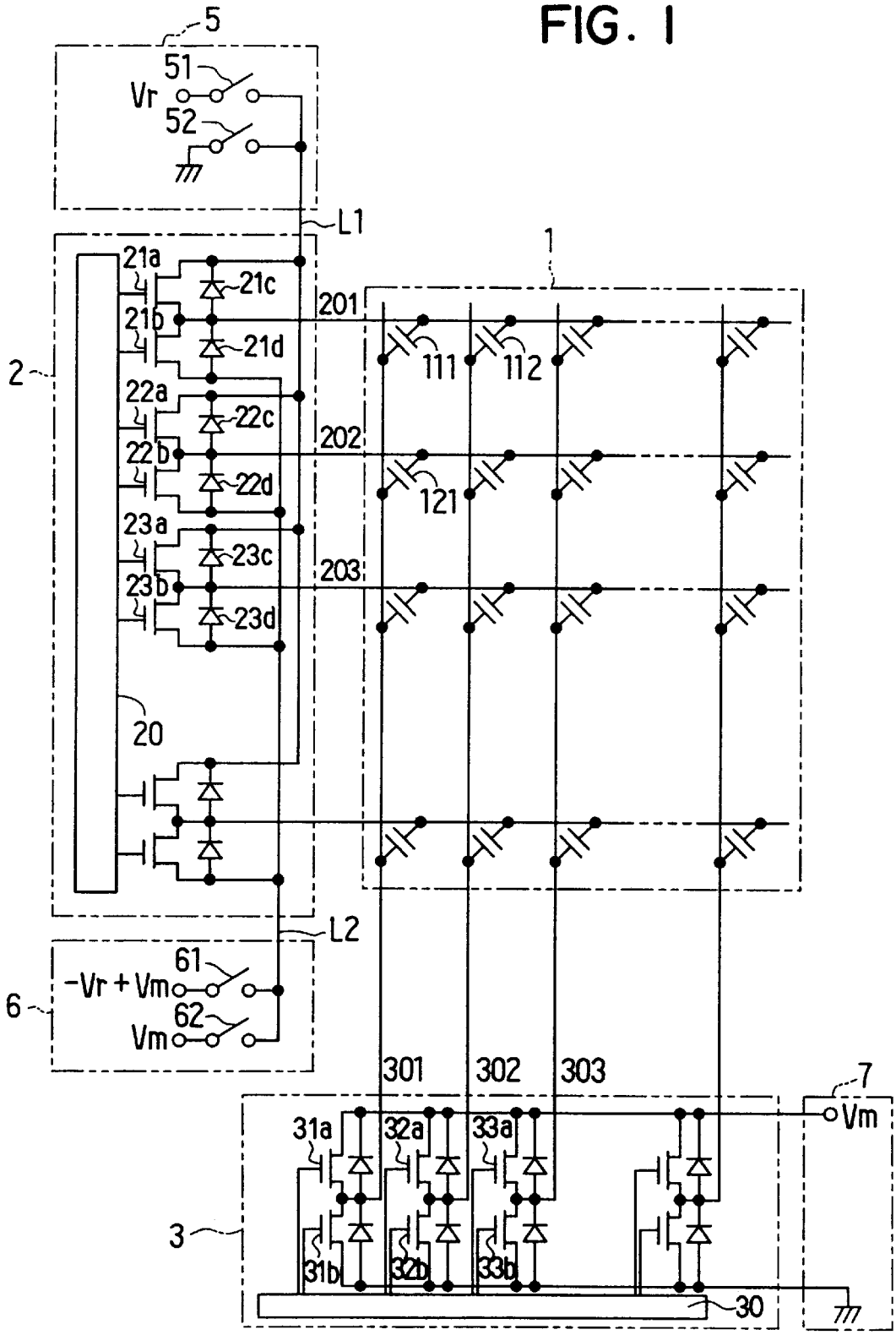
FIG. 1 is a circuit diagram showing a display panel and driving circuits thereof as a first embodiment of the present invention.

A first embodiment of the present invention will be described in reference to FIGS. 1 to 4. First, referring to FIG. 1, the whole structure of a display device will be described. The display device is composed of a display panel 1, a scanning electrode driving circuit 2, a data electrode driving circuit 3, scanning voltage supply circuits 5 and 6, and a data voltage supply circuit 7. The display panel 1 is composed of a luminescent layer such as an electroluminescent layer, an array of scanning electrodes 201, 202, 203 . . . formed on one surface of the luminescent layer, an array of data electrodes 301, 302, 303 . . . formed on the other surface of the luminescent layer. The array of the scanning electrodes runs in the row direction of the panel 1, and the array of data electrodes runs in the column direction, so that both arrays perpendicularly cross each other. Electroluminescent pixels 111, 112 . . . 121 . . . are formed at each intersection of the scanning and data electrodes, forming a matrix arrangement. Because the electroluminescent pixels are capacitive elements, they are shown as capacitors in FIG. 1.

The scanning electrode driving circuit 2 for supplying scanning voltages to the scanning electrodes 201, 202, 203 . . . is connected to the scanning electrodes, and the data electrode driving circuit 3 for supplying data voltages to the data electrodes 301, 302, 303 . . . is connected to the data electrodes. The scanning electrode driving circuit 2 includes a push-pull driving circuit composed of P-channel FETs 21*a*, 22*a*, 23*a* . . . and N-channel FETs 21*b*, 22*b*, 23*b* . . . , and a controller 20 that controls operation of the push-pull driving circuit. The push-pull driving circuit supplies the scanning voltages selectively to the scanning electrodes according to signals from the controller 20. Parasitic diodes 21*c*, 21*d*, 22*c*, 22*d*, 23*c*, 23*d* . . . are formed in respective FETs as shown in FIG. 1, and they set the scanning voltage to a desired base voltage.

The data electrode driving circuit 3 includes a push-pull circuit composed of P-channel FETs 31*a*, 32*a*, 33*a* . . . and N-channel FETs 31*b*, 32*b*, 33*b* . . . , and a controller 30. The data voltages are supplied from the push-pull circuit to the data electrodes according to signals from the controller 30.

The scanning voltage supply circuits 5 and 6 supply the scanning voltages to the scanning electrode driving circuit 2. The scanning voltage supply circuit 5 includes switching elements 51 and 52, and a writing voltage Vr or a ground voltage Vg (0 volt) is supplied to a common line L1 connected to source terminals of P-channel FETS according to turning ON or OFF of the switching elements 51 and 52. The scanning voltage supply circuit 6 includes switching elements 61 and 62, and a writing voltage –(Vr–Vm) or an offset voltage Vm is supplied to a common line L2 connected to source terminals of N-channel FETs according to turning ON or OFF of the switching elements 61 and 62.

The data voltage supply circuit 7 supplies a modulation voltage Vm (the level of which is the same as that of the offset voltage) to a common line connected to source terminals of P-channel FETs and the ground voltage Vg to a common line connected to source terminals of N-channel FETs.

Composite voltages combining the scanning voltages with the data voltages are imposed on each pixel formed at each intersection of the scanning and data electrodes. The voltages imposed on the pixels are supplied as pulses, the polarities of which are alternated field by field. Referring to the timing chart shown in FIG. 2, details of the scanning and data voltages and the composite voltages will be explained. The left half of the timing chart shows those voltage pulses in the positive field, while the right half shows those in the negative field.

First, operation in the positive field will be explained, referring to the left half of the timing chart. At the beginning of the positive field, the switching elements 51 and 62 are turned ON, while the switching elements 52 and 61 are turned OFF. At this moment, the base voltage of the scanning electrodes 201, 202, 203 . . . is set to Vm by the operation of the parasitic diodes 21*d*, 22*d*, 23*d* . . . in the FETs of the scanning electrode driving circuit 2. The P-channel FETs 31*a*, 32*a*, 33*a* . . . in the data electrode driving circuit 3 are turned ON, thereby supplying voltage Vm to the data electrodes 301, 302, 303 . . . Since the voltage supplied to all the pixels is 0 volt at this stage, the pixels do not emit light.

At the next stage, N-channel FETs 31*b*, 32*b*, 33*b* . . . of the data electrode driving circuit 3 are turned ON, thereby bringing the voltage supplied to the data electrodes 301, 302, 303 . . . to the ground voltage Vg. At this time, current flows from all the scanning electrodes to the data electrode driving circuit 3 through the pixels by operation of the parasitic diodes 21*d*, 22*d*, 23*d* . . . , and thereby all the pixels are charged to the level of the modulation voltage Vm. Then, the P-channel FETs 31*a,* 32*a,* 33*a* . . . of the data electrode driving circuit 3 are turned ON again, thereby bringing the voltage level of the data electrodes 301, 302, 303 . . . to Vm. At this stage, charges stored in the pixels are not discharged due to the reverse polarity of the parasitic diodes of the scanning electrode driving circuit 2.

Figure 2:
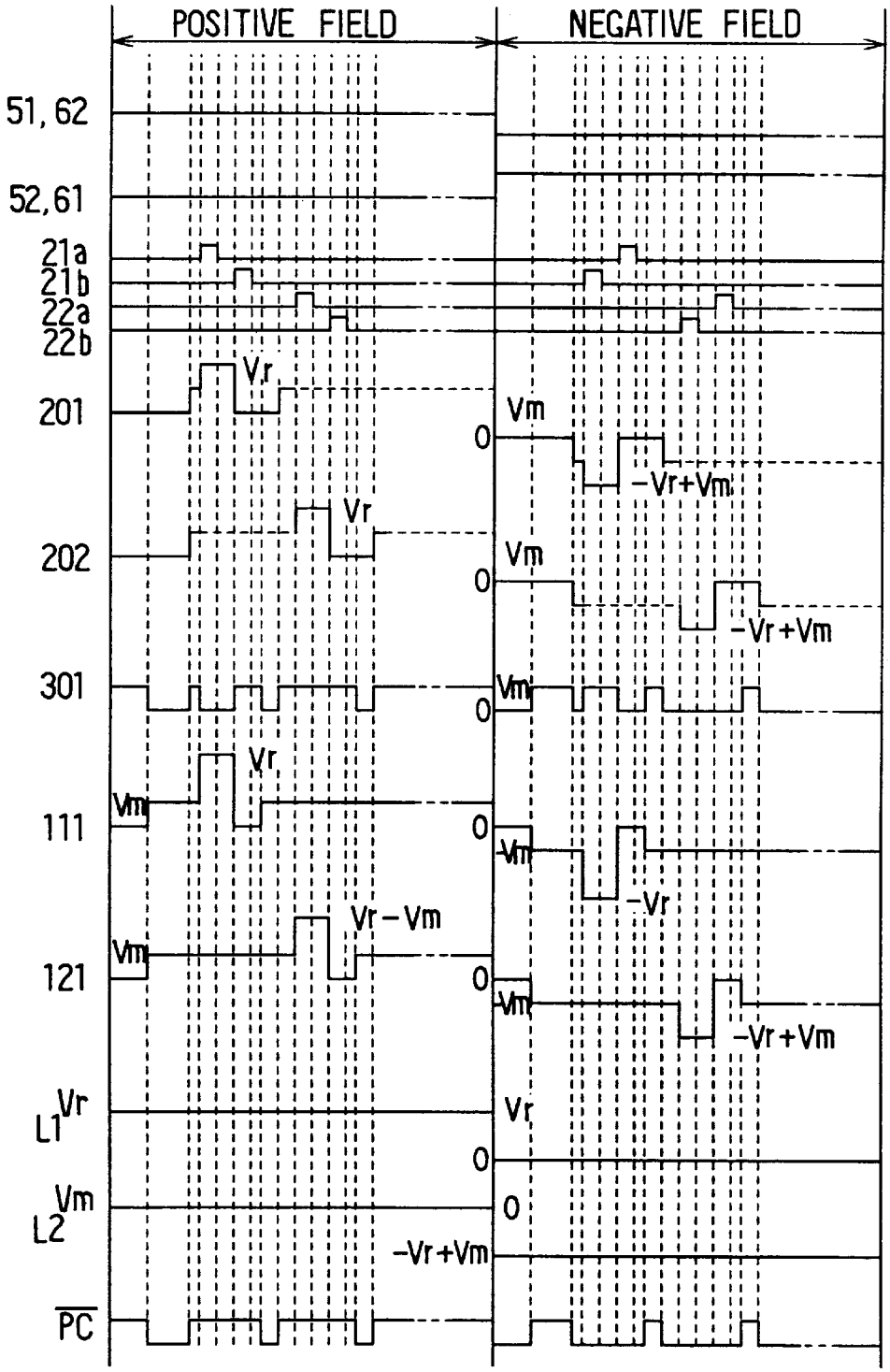
FIG. 2 is a timing chart showing various signals and voltages for driving the display panel shown in FIG. 1.

After all the pixels are charged to the level of Vm, the driving operation in the positive field starts. First, the P-channel FET 21*a* of the scanning electrode driving circuit 2 is turned ON, thereby bringing the voltage of the first scanning electrode 201 to Vr. At the same time, output stage FETs connected to other scanning electrodes are all turned OFF, thereby bringing those scanning electrodes to a floating state. On the other hand, P-channel FETs of the data electrode driving circuit 3, connected to the data electrodes corresponding to the pixels to be lit, are turned OFF, while those N-channel FETs are turned ON. At the same time, P-channel FETs connected to the data electrodes corresponding to the pixels not to be lit are turned ON, while those N-channel FETs are turned OFF. By the above switching operations, the voltage of the data electrodes corresponding to the pixels to be lit is brought to the level of Vr that is higher than a threshold voltage for activating the pixels, and thereby those pixels emit light. Since the voltage of the data electrodes corresponding to the pixels not to be lit is kept at the level of Vm, the voltage (Vr−Vm) is imposed on those pixels, thereby keeping those pixels unlit. The timing chart shown in FIG. 2 shows a situation where P-channel FET 31*a* of the data electrode driving circuit 2 is turned OFF, and N-channel FET 31*b* is turned ON, thereby imposing voltage Vr on the pixel 111 to emit light therefrom.

Then, the P-channel FET 21*a* is turned OFF, the N-channel FET 21*b* is turned ON, the P-channel FETs 31*a,* 32*a,* 33*a* . . . of the data electrode driving circuits 3 are all turned ON, and the N-channel FETs 31*b,* 32*b,* 33*b* . . . are all turned OFF. Thereby, charges stored in the pixels on the scanning electrode 201 are all discharged, temporarily bringing the voltage imposed on those pixels to 0 volt. Then, the N-channel FETs 31*b,* 32*b,* 33*b* . . . are turned ON, thereby bringing the voltage of the data electrodes 301, 302, 303 . . . to the ground voltage Vg. As a result, once discharged pixels on the scanning electrode 201 are charged again to the level of modulation voltage Vm, because the charging current flows from the scanning electrode 201 to the data electrode driving circuit 3 through those pixels 111, 112 . . . by operation of the parasitic diodes 21*d* in the scanning electrode driving circuit 2. Therefore, all the pixels are charged again to the level of the modulation voltage Vm. Then, the P-channel FETs 31*a,* 32*a,* 33*a* . . . of the data electrode driving circuit 3 are turned ON, thereby bringing the voltage of the data electrodes 301, 302, 303 . . . to Vm. At this time, the charges stored in the pixels are not discharged due to the reverse polarity of the parasitic diodes in the scanning electrode driving circuit 2.

Following the above operation, the second scanning electrode 202 is scanned. The P-channel FET 22*a* of the scanning electrode driving circuit 2 connected to the second scanning electrode 202 is turned ON, thereby bringing the voltage of the scanning electrode 202 to Vr. At the same time, the output stage FETs connected to the scanning electrodes other than 202 are all turned OFF, thereby bringing those scanning electrodes to a floating state. The voltage levels of the data electrodes 301, 302, 303 . . . are set to respective levels corresponding to pixels to be lit and to pixels not to be lit in the same manner as in the scanning of the first scanning electrode 201. The timing chart shown in FIG. 2 shows a situation where the P-channel FET 31*a* is turned ON, and the N-channel FET 31*b* is turned OFF, thereby bringing the voltage of the data electrode 301 to Vm and imposing voltage (Vr−Vm) on the pixel 121 not to light that pixel.

Then, the FET 22*a* connected to the second scanning electrode 202 is turned OFF, the N-channel FET 22*b* is turned ON, the P-channel FETs 31*a,* 32*a,* 33*a* . . . of the data electrode driving circuit 3 are turned ON, and the N-channel FETs 31*b,* 32*b,* 33*b* . . . are turned OFF, and thereby the charges stored in the pixels on the second electrode 202 are discharged.

Then, the N-channel FETs 31*b,* 32*b,* 33*b* . . . of the data electrode driving circuit 3 are turned ON, thereby bringing the voltage of the data electrodes 301, 302, 303 . . . to the ground voltage Vg. As a result, once discharged pixels on the scanning electrode 202 are charged again to the level of modulation voltage Vm, because the charging current flows from the scanning electrode 202 to the data electrode driving circuit 3 through those pixels 121, 122 . . . by operation of the parasitic diodes 22*d* in the scanning electrode driving circuit 2. Therefore, all the pixels are charged again to the level of the modulation voltage Vm. Then, the P-channel FETs 31*a,* 32*a,* 33*a* . . . of the data electrode driving circuit 3 are turned ON, thereby bringing the voltage of the data electrodes 301, 302, 303 . . . to Vm. At this time, the charges stored in the pixels are not discharged due to the reverse polarity of the parasitic diodes in the scanning electrode driving circuit 2.

Thereafter, the same operation described above is repeated to cover all the scanning electrodes up to the bottom of the display panel. When all the scanning electrodes are scanned in this manner, the positive field is completed, and the negative field follows.

Secondly, operation in the negative field will be explained, referring to the right half of the timing chart shown in FIG. 2. At the beginning of the negative field, the switching elements 52 and 61 are turned ON, while the switching elements 51 and 62 are turned OFF, thereby reversing polarity of the positive field to that of the negative field. At this moment, the base voltage of the scanning electrodes 201, 202, 203 . . . is set to the ground voltage Vg. The N-channel FETs 31*b,* 32*b,* 33*b* . . . in the data electrode driving circuit 3 are turned ON, thereby supplying voltage Vg to the data electrodes 301, 302, 303 . . . Since the voltage supplied to all the pixels is 0 volt at this stage, the pixels do not emit light.

At the next stage, P-channel FETs 31*a,* 32*a,* 33*a* . . . of the data electrode driving circuit 3 are turned ON, thereby bringing the voltage supplied to the data electrodes 301, 302, 303 . . . to the modulation voltage Vm. At this time, current flows from all the pixels to the scanning electrode driving circuit 2 through the scanning electrodes by operation of the parasitic diodes 21*c,* 22*c,* 23*c* . . . , and thereby all the pixels are charged to the level of −Vm. Then, the N-channel FETs 31*b,* 32*b,* 33*b* . . . of the data electrode driving circuit 3 are turned ON again, thereby bringing the voltage level of the data electrodes 301, 302, 303 . . . to Vg. At this stage, charges stored in the pixels are not discharged due to the reverse polarity of the parasitic diodes of the scanning electrode driving circuit 2.

After all the pixels are charged to the level of −Vm, the driving operation in the negative field starts. First, the N-channel FET 21*b* of the scanning electrode driving circuit 2 is turned ON, thereby bringing the voltage of the first scanning electrode 201 to −(Vr−Vm). At the same time, output stage FETs connected to other scanning electrodes are all turned OFF, thereby bringing those scanning electrodes to a floating state. On the other hand, P-channel FETs of the data electrode driving circuit 3, connected to the data electrodes corresponding to the pixels to be lit, are turned ON, while those N-channel FETs are turned OFF. At the same time, P-channel FETs connected to the data electrodes corresponding to the pixels not to be lit are turned OFF, while those N-channel FETs are turned ON. By the above switching operations, the voltage of the data electrodes corresponding to the pixels to be lit is brought to the level of Vm and the voltage imposed on those pixels becomes −Vr that is greater than a threshold voltage for activating the pixels, and thereby the pixels to be lit emit light. Since the voltage of the data electrodes corresponding to the pixels not to be lit is kept at the level of Vg, the voltage −(Vr−Vm) is imposed on those pixels, thereby keeping those pixels unlit. The timing chart shown in FIG. 2 shows a situation where P-channel FET 31*a* of the data electrode driving circuit 2 is turned ON, and N-channel FET 31*b* is turned OFF, thereby imposing voltage −Vr on the pixel 111 to light it.

Then, the P-channel FET 21*a* is turned ON, the Nchannel FET 21*b* is turned OFF, the P-channel FETs 31*a,* 32*a,* 33*a* . . . of the data electrode driving circuits 3 are all turned OFF, and the N-channel FETs 31*b,* 32*b,* 33*b* . . . are all turned ON. Thereby, charges stored in the pixels on the scanning electrode 201 are all discharged, temporarily bringing the voltage imposed on those pixels to 0 volt. Then, the P-channel FETs 31*a,* 32*a,* 33*a* . . . are turned ON, thereby bringing the voltage of the data electrodes 301, 302, 303 . . . to Vm. As a result, once discharged pixels on the scanning electrode 201 are charged again to the level of −Vm, because the charging current flows from the pixels 111, 112 . . . to the scanning electrode driving circuit 2 through the scanning electrode 201 by operation of the parasitic diodes 21*c* in the scanning electrode driving circuit 2. Therefore, all the pixels are charged again to the level of −Vm. Then, the N-channel FETs 31*b,* 32*b,* 33*b* . . . of the data electrode driving circuit 3 are turned ON, thereby bringing the voltage of the data electrodes 301, 302, 303 . . . to Vg. At this time, the charges stored in the pixels are not discharged due to the reverse polarity of the parasitic diodes in the scanning electrode driving circuit 2.

Following the above operation, the second scanning electrode 202 is scanned. The N-channel FET 22*b* of the scanning electrode driving circuit 2 connected to the second scanning electrode 202 is turned ON, thereby bringing the voltage of the scanning electrode 202 to −(Vr−Vm). At the same time, the output stage FETs connected to the scanning electrodes other than 202 are all turned OFF, thereby bringing those scanning electrodes to a floating state. The voltage levels of the data electrodes 301, 302, 303 . . . are brought to respective levels corresponding to pixels to be lit and to pixels not to be lit in the same manner as in the scanning of the first scanning electrode 201. The timing chart shown in FIG. 2 shows a situation where the P-channel FET 31*a* is turned OFF, and the N-channel FET 31*b* is turned ON, thereby bringing the voltage of the data electrode 301 to Vg and imposing voltage −(Vr−Vm) on the pixel 121 not to light that pixel.

Then, the FET 22*a* connected to the second scanning electrode 202 is turned ON, the N-channel FET 22*b* is turned OFF, the P-channel FETs 31*a,* 32*a,* 33*a* . . . of the data electrode driving circuit 3 are turned OFF, and the N-channel FETs 31*b,* 32*b,* 33*b* . . . are turned ON, and thereby the charges stored in the pixels on the second electrode 202 are discharged.

Then, the P-channel FETs 31*a,* 32*a,* 33*a* . . . of the data electrode driving circuit 3 are turned ON, thereby bringing the voltage of the data electrodes 301, 302, 303 . . . to Vm. As a result, once discharged pixels on the scanning electrode 202 are charged again to the level of −Vm, because the charging current flows from the pixels 121, 122 . . . to the scanning electrode driving circuit 2 through the scanning electrode 202 by operation of the parasitic diodes 22*c* in the scanning electrode driving circuit 2. Therefore, all the pixels are charged again to the level of −Vm. Then, the N-channel FETs 31*b,* 32*b,* 33*b* . . . of the data electrode driving circuit 3 are turned ON, thereby bringing the voltage of the data electrodes 301, 302, 303 . . . to Vg. At this time, the charges stored in the pixels are not discharged due to the reverse polarity of the parasitic diodes in the scanning electrode driving circuit 2. Thereafter, the same operation described above is repeated to cover all the scanning electrodes up to the bottom of the display panel. When all the scanning electrodes are scanned in this manner, the negative field is completed.

One cycle of display, or one frame, is composed of a positive field and a negative field, and that cycle is repeated to display images on the display panel 1.

As described above, all the pixels are charged to the level of Vm or −Vm before the first scanning starts in both of the positive and negative fields, and the pixels on a scanned scanning electrode are charged again to the level of Vm or −Vm before the scanning moves to the next scanning electrode. Therefore, the turnaround current otherwise flowing to the pixels on the scanning electrodes other than a scanning electrode being presently scanned is eliminated, and accordingly uneven brightness among scanning electrodes is prevented. When the panel is driven under an output limited by resistance, inductance or the like connected to the scanning electrode driving circuits 2 and/or the data electrode driving circuit 3, the present invention is especially effective, because a high level of the uneven brightness is otherwise caused by the turnaround current in that structure.

Figure 3:
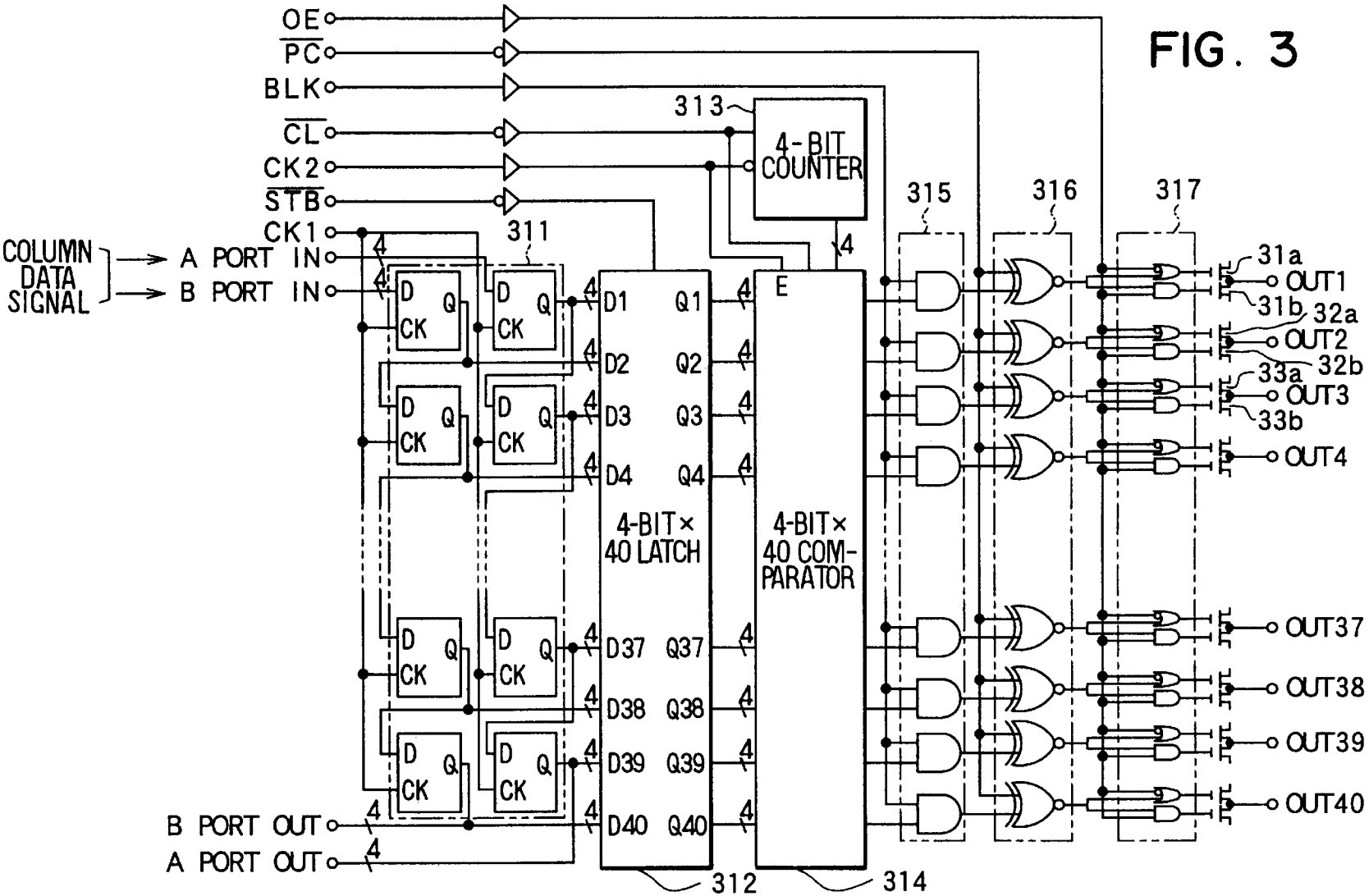
FIG. 3 is a circuit diagram showing a data electrode driving circuit.

Referring to FIG. 3, the structure and operation of the data electrode driving circuit 3 that includes the function for charging the pixels to the level of the modulation voltage Vm will be described. The data electrode driving circuit 3 is composed of: a shift register circuit 311; a latch circuit 312; a counter 313; a comparator 314; an AND circuit 315; an exclusive logical sum circuit 316; an output circuit 317; and a push-pull circuit including P-channel FETs 31*a,* 32*a,* 33*a* . . . and N-channel FETs 31*b,* 32*b,* 33*b* . . .

4-bit column data signals (stepwise data for displaying images having stepwise brightness) are fed to the shift register circuit 311 from "A PORT IN" and "B PORT IN". The input column data signals are transferred to each shift register in synchronism with the rising of a dot-clock signal CK1, as shown in FIG. 3. After all the column data signals are transferred to the shift register circuit 311, the output of the shift register circuit 311 at that time is latched in the latch circuit 312 when a STB-bar signal becomes a low level (L) and is maintained therein during a period in which the STB-bar signal is at the low level (L). Then, the counter 313 and the comparator 314 that determine a pulse width of the voltage imposed on the luminescent layer become operable, when a CL-bar signal level changes from low (L) to high (H). At this time, the comparator 314 outputs an H level signal except when the column data signal is 0 volt (no display at 0 volt).

The counter 313 counts up according to a clock signal CK2, the comparator 314 compares the counted value with respective outputs Q1–Q40 latched in the latch circuit 312, and converts the level of the outputs that coincide with the counted value from H to L. The outputs of the comparator 314 are fed to the AND circuit 315. In this particular embodiment, a BLK (blanking) signal is always kept at H, and the output of the comparator 314 is fed, with the level as it is, to one terminal of the exclusive logical sum circuit 316. An inversed PC-bar signal is fed to the other terminal of the exclusive logical sum circuit 316. The waveform of the PC-bar signal is set as shown in the bottom line of FIG. 2. That is, in the positive field, the PC-bar signal becomes L for a predetermined period before scanning of the first row starts and after completion of scanning of each row, and it becomes H in other periods. In the negative field, the PC-bar signal becomes H for a predetermined period before scanning of the first row starts and after completion of scanning of each row, and it becomes L in other periods. As a result, in the positive field, an H level signal is fed to the output circuit 317 before scanning of the first row starts and after completion of scanning of each row, and the output of the comparator 314 is fed to the output circuit 317 in other periods. In the negative field, an L level signal is fed to the output circuit 317 before scanning of the first row starts and after completion of scanning of each row, and the inversed output of the comparator 314 is fed to the output circuit 317 in other periods.

An OE (output enabling) signal that is always kept at an H level in this embodiment is fed to each logic element of the output circuit 317. Therefore, the N-channel FET turns ON when the output of the exclusive logical sum circuit 316 is H, while the P-channel FET turns ON when that output is L. As a result, data voltages according to the stepwise data are supplied to the data electrodes 301, 302, 303 . . . in both the positive and negative fields. In the positive field, only N-channel FETs 31*b*, 32*b*, 33*b* . . . of the data electrode driving circuit 3 are turned ON before scanning of the first row starts and after completion of scanning of each row, bringing the voltage of the data electrodes 301, 302, 303 . . . to the ground level Vg, and thereby the pixels are charged with the modulation voltage Vm. In the negative field, only P-channel FETs 31*a*, 32*a*, 33*a* . . . of the data electrode driving circuit 3 are turned ON before scanning of the first row starts and after completion of scanning of each row, bringing the voltage of the data electrodes 301, 302, 303 . . . to level of −Vm, and thereby the pixels are charged with the voltage −Vm.

In FIG. 3, the data electrode driving circuit supplying 40 outputs is shown. However, the number of the outputs can be arbitrarily increased by connecting "A PORT OUT" and "B PORT OUT" of one driving circuit to "A PORT IN" and "B PORT IN" of another driving circuit, respectively.

Figure 4:
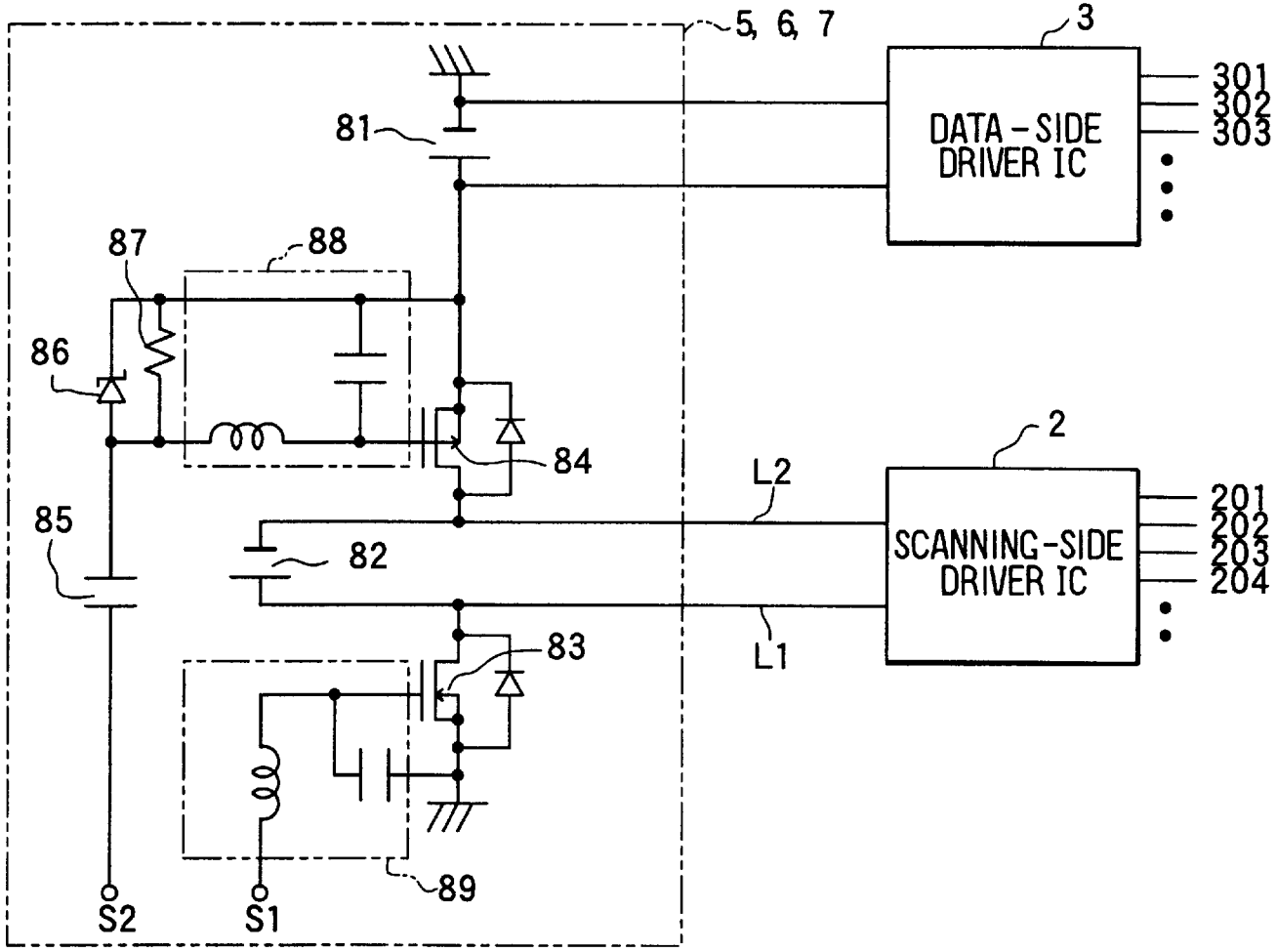
FIG. 4 is a circuit diagram showing voltage sources for scanning and data electrode driving circuits.

Referring to FIG. 4, the structure and operation of the scanning voltage supply circuit 5 and 6, and the data voltage supply circuit 7 will be described. The voltage supply circuits 5, 6 and 7 are integrally built in a one power source circuit as shown in FIG. 4. The power source circuit includes a first power source 81 having a voltage Vm and a second power source 82 having a voltage (Vr−Vm). An anode of the first power source 81 and a cathode of the second power source 82 are connected through a P-channel FET 84 (a first switch). An anode of the second power source 82 is grounded through an N-channel FET 83 (a second switch). A control signal is fed to the P-channel FET 84 from an input terminal S2 through a coupling condenser 85, a Zener diode 86 for protecting input, a resistor 87 and a filter circuit 88. Another control signal is fed to the N-channel FET 83 from an input terminal S1 through a filter circuit 89.

In the positive field, low level signals are fed to both input terminals S1 and S2, thereby turning OFF the N-channel FET 83 and turning ON the P-channel FET 84. At this time, the voltage Vm of the first power source 81 is output as the offset voltage to the common line L2 connected to source terminals of N-channel FETs from the cathode of the second power source 82. The voltage Vr (=Vr−Vm+Vm) is output to the common line L1 connected to source terminals of P-channel FETs from the anode of the second power source 82. The voltage Vm and the ground level voltage Vg are supplied to the data electrode driving circuit 3 from the first power source 81. Those voltages constitute the driving voltage in the positive field.

In the negative field, high level signals are fed to both input terminals S1 and S2, thereby turning ON the N-channel FET 83 and turning OFF the P-channel FET 84. At this time, the voltage (−Vr+Vm) is output to the common line L2 connected to source terminals of N-channel FETs from the cathode of the second power source 82. The ground voltage Vg is output to the common line L1 connected to source terminals of P-channel FETs from the anode of the second power source 82. Those voltages constitute the driving voltage in the negative field. The scanning and data electrode driving circuits 2 and 3, and the data voltage supply circuits 5, 6, and 7 are controlled by various control signals fed from outside controllers though they are not shown here.

The voltage supply circuits 5, 6 and 7 are integrally formed as described above, and the voltages Vr and Vm in the positive field and the voltages −(Vr−Vm) and Vg in the negative field are supplied to the scanning electrode driving circuit 2 from a single power source 82. The common lines L1 and L2 connecting the power source 82 to the scanning electrode driving circuit 2 include certain resistance (resistors may be added in those lines when such are required), and the FETs 83 and 84 also include certain on-resistance. Therefore, if the pixels were not previously charged with the voltage Vm (or −Vm in the negative field), the turnaround current would flow into pixels that are not being scanned when a selected scanning electrode is scanned due to those resistances included in lines L1 and L2 and on-resistances of the FETs. When such turnaround current flows, the offset voltage Vm decreases in the positive field, and the ground voltage Vg increases in the negative field, thereby changing the level of the driving voltages Vr and −(Vr−Vm). Accordingly, sufficient voltages to activate the pixels are not supplied to the pixels.

According to the present invention, the pixels are previously charged to the level of Vm to eliminate the turnaround current. Therefore, the level of driving voltages Vr and −(Vr−Vm) are stabilized.

It is possible to use separate power source circuits in place of the integrated power source circuit shown in FIG. 4. In this case, however, even when the voltage of the common line L2 becomes lower than the voltage Vm in the positive field, the voltage Vr of the common line L1 does not change. Accordingly, the voltage supplied to the scanning electrode driving circuit 2 becomes higher than the voltage (Vr−Vm). In the negative field, even when the L1 voltage becomes higher than the ground voltage Vg, the L2 voltage (Vr−Vm) does not change. Accordingly, the voltage supplied to the scanning electrode driving circuit 2 becomes higher than the voltage (Vr−Vm). Therefore, in this case, it is necessary to make the scanning electrode driving circuit 2 endure a higher voltage.

Figure 5:
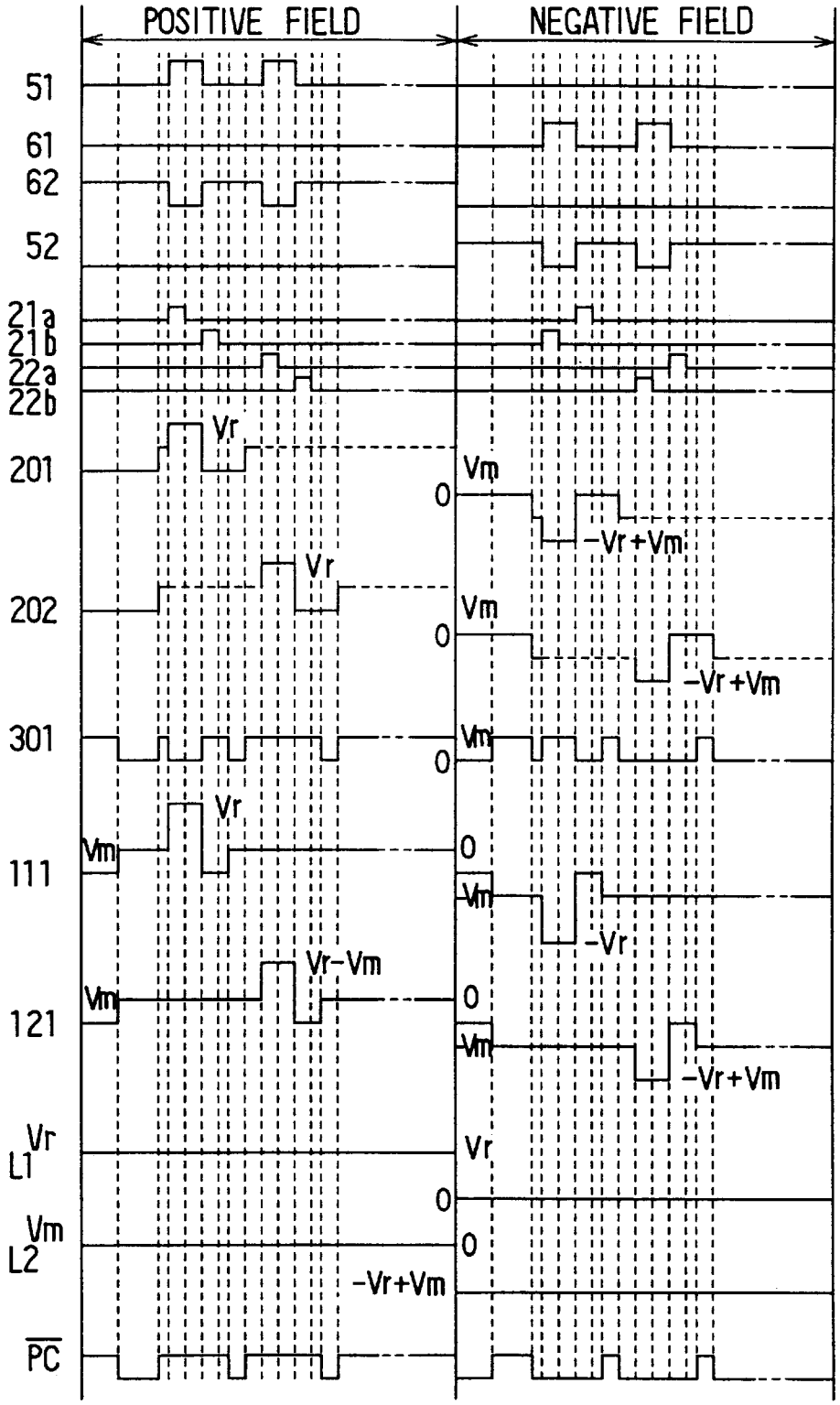
FIG. 5 is a timing chart showing various signals and voltages for driving the display panel, slightly modified from the timing chart shown in FIG. 2.

However, this problem can be overcome by modifying the switching timing of the switching elements 51, 52, 61 and 62, as shown in the timing chart shown in FIG. 5, without increasing the voltage endurance of the scanning electrode driving circuit 2. That is, in the positive field, the switching element 51 is turned ON and the switching element 62 is turned OFF, when the scanning voltage is supplied to the scanning electrode. In this manner, the voltage of the common line L2 can be made Vm, thereby making the voltage supplied to the scanning electrode driving circuit 2 to the level of (Vr−Vm). In the negative field, the switching element 61 is turned ON and the switching element 52 is turned OFF, when the scanning voltage is supplied to the scanning electrode. In this manner, the voltage of the common line L1 can be made Vg, thereby making the voltage supplied to the scanning electrode driving circuit 2 to the level of (Vr−Vm).

Figure 6:
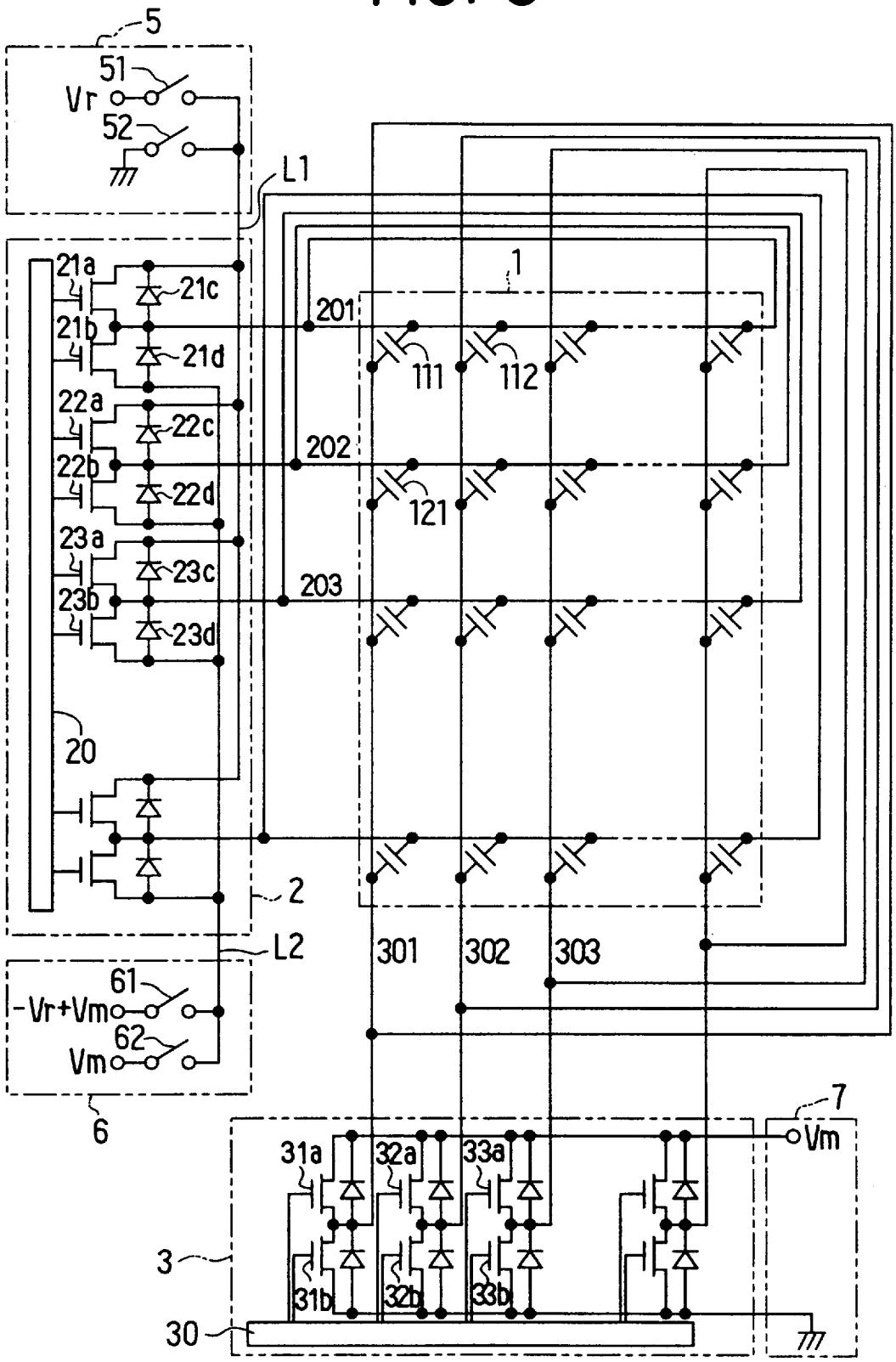
FIG. 6 is a circuit diagram showing a display panel and driving circuits thereof as a modified form of the first embodiment shown in FIG. 1.

As shown in FIG. 6, the scanning voltages may be supplied from both ends of each scanning electrode, and similarly data voltages may be supplied from both ends of each data electrode. In this manner, deformation of the supplied voltages due to resistance of connecting wires can be alleviated, and all the pixels can be more quickly charged. Accordingly, a scanning interval between one scanning electrode and the next electrode can be made shorter, and thereby the scanning frequency can be increased to obtain a higher luminance.

A second embodiment of the present invention will be described in reference to FIG. 7. In this embodiment, after completion of scanning of one scanning electrode, impedance of all the data electrodes 301, 302, 303 . . . is made high. Thus, electric charges stored in the pixels on the scanned electrode are transferred to other pixels on the scanning electrodes not scanned. In other words, the turnaround current is intentionally supplied to other pixels to charge them to the level of the modulation voltage Vm. For this purpose, after the scanning voltage is supplied to a selected scanning electrode by turning ON the P-channel FET connected to that electrode, the N-channel FET connected to that electrode is turned ON, and the data electrodes 301, 302, 303 . . . are brought to high impedance at the timing to discharge the pixels on the scanned electrode.

Figure 7:
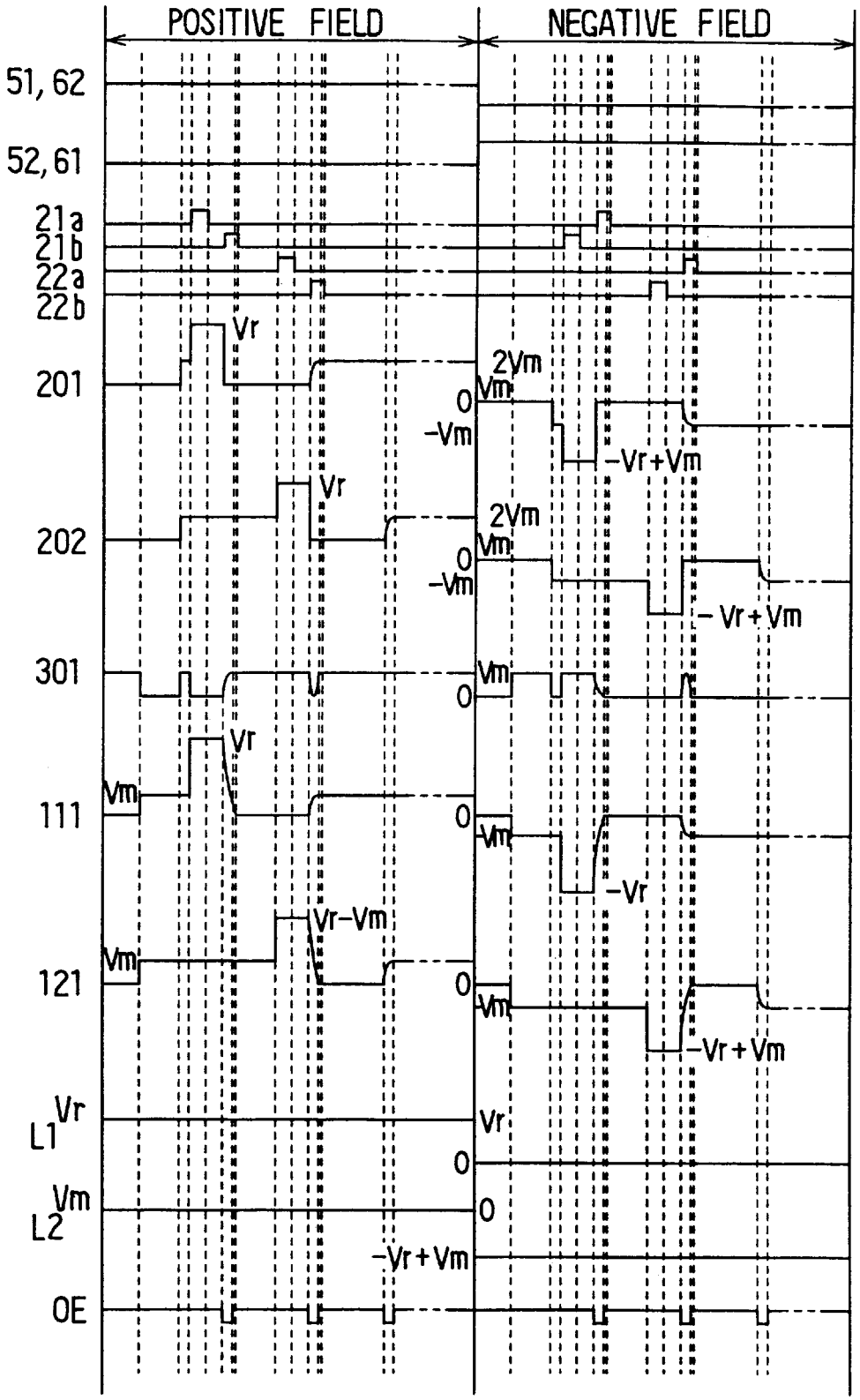
FIG. 7 is a timing chart showing various signals and voltages for driving a display panel as a second embodiment of the present invention.

More particularly, as shown in the timing chart of FIG. 7, PC-bar signals are fixed to an H level in the positive field and to an L level in the negative field, without changing the structure of the data electrode driving circuit 3 shown in FIG. 3. Instead, the OE-bar signal is set at L level when the pixels on the selected scanning electrode are discharged, thereby making impedance of all the data electrodes 301, 302, 303 . . . high. That is, when the OE-bar signal becomes L, the output level of the OR-gate of the output circuit 317 becomes H, and the output level of the AND-gate becomes L. Thereby, P-channel FETs 31*a*, 32*a*, 33*a* . . . and N-channel FETs 31*b*, 32*b*, 33*b* . . . of the data electrode driving circuit 3 are all turned OFF, and thereby impedance of all the data electrodes 301, 302, 303 . . . becomes high. Thus, the charges stored in the pixels on the scanning electrode scanned can be transferred to other pixels on the electrodes not scanned to charge those pixels to the level of the modulation voltage Vm.

The mechanism of the charge transfer can be explained as follows. Plus charges are accumulated on the scanning electrode side of the pixels scanned, and minus charges on the data electrode side. The plus charges are discharged through a formed discharge path including the scanning electrode, while the minus charges flow to pixels on other scanning electrodes not scanned as turnaround current, because the data electrodes are brought to the high impedance state. As a result, the pixels on other scanning electrodes not scanned are charged to the level of the modulation voltage Vm.

Since the pixels are charged to the Vm level in the second embodiment, too, the uneven brightness among the scanning electrodes is alleviated. Since the charges stored in the pixels on the scanned electrode are utilized to charge other pixels in the second embodiment, power for driving the display panel is saved. The timing to bring the data electrodes to the high impedance state may not be required to accord with the timing to discharge the pixels on the scanned electrode, as long as other pixels are charged to the level of Vm. In the second embodiment, too, all the pixels may be previously charged to the level of Vm before the first scanning electrode is scanned in both positive and negative fields.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A display device comprising:

a display panel having a luminescent layer, an array of scanning electrodes disposed on one surface of the luminescent layer and an array of data electrodes disposed on the other surface of the luminescent layer, the scanning electrodes perpendicularly crossing the data electrodes, capacitive pixels being formed at each intersection of both electrodes together with the luminescent layer, the pixels being arranged in a matrix;

a scanning electrode driving circuit for supplying scanning voltages to the scanning electrodes; and a data electrode driving circuit for supplying data voltages to the data electrodes, wherein:

the scanning electrodes are sequentially scanned by sequentially supplying the scanning voltages thereto;

composite voltages consisting of the scanning voltages and the data voltages are imposed on the pixels thereby to activate the pixels to emit light; and the pixels on a scanning electrode once scanned are charged by supplying turnaround current before the next scanning electrode is scanned to prevent the turnaround current from being supplied to the pixels on the scanned scanning electrode when other scanning electrodes are scanned.

2. The display device as in claim 1, wherein:

the pixels on one of the scanning electrodes once scanned and the pixels on other scanning electrodes not scanned are charged to a level of a modulation voltage of the data voltages by supplying turnaround current thereto, after scanning of the one of the scanning electrodes is completed and before scanning of the next scanning electrode begins.

3. A display device comprising:

a display panel having a luminescent layer, an array of scanning electrodes disposed on one surface of the luminescent layer and an array of data electrodes disposed on the other surface of the luminescent layer, the scanning electrodes perpendicularly crossing the data electrodes, capacitive pixels being formed at each intersection of both electrodes together with the luminescent layer, the pixels being arranged in a matrix;

a scanning electrode driving circuit for supplying scanning voltages to the scanning electrodes; and a data electrode driving circuit for supplying data voltages to the data electrodes, wherein:

the scanning electrodes are sequentially scanned by sequentially supplying the scanning voltages thereto;

composite voltages consisting of the scanning voltages and the data voltages are imposed on the pixels thereby to activate the pixels to emit light;

the pixels on a scanning electrode once scanned are charged with a modulation voltage of the data voltages before the next scanning electrode is scanned; and the pixels on the scanning electrodes not scanned are charged with the modulation voltage when the data voltages are at a level to activate the pixels to emit light.

4. The display device as in claim 3, wherein:

charges stored in the pixels on the scanning electrode once scanned are discharged before the pixels are charged with the modulation voltage.

5. The display device as in claim 3, wherein:

the pixels are charged with the modulation voltage by bringing a voltage level of all the data electrodes to a level enabling such charging.

6. The display device as in claim 3, wherein:

all the pixels in the display panel are charged with the modulation voltage before a first scanning electrode is scanned.

7. The display device as in claim 3, wherein:

the scanning electrodes and/or the data electrodes are supplied with the voltages simultaneously from both ends thereof.

8. A display device comprising:

a display panel having a luminescent layer, an array of scanning electrodes disposed on one surface of the luminescent layer and an array of data electrodes disposed on the other surface of the luminescent layer, the scanning electrodes perpendicularly crossing the data electrodes, capacitive pixels being formed at each intersection of both electrodes together with the luminescent layer, the pixels being arranged in a matrix;

a scanning electrode driving circuit for supplying scanning voltages to the scanning electrodes; and a data electrode driving circuit for supplying data voltages to the data electrodes, wherein:

the scanning electrodes are sequentially scanned by sequentially supplying the scanning voltages thereto;

composite voltages consisting of the scanning voltages and the data voltages are imposed on the pixels thereby to activate the pixels to emit light; and after one of the scanning electrodes is scanned, the data electrodes are brought to a high impedance state, and thereby the pixels on other scanning electrodes not scanned are charged.

9. The display device as in claim 8, wherein:

charges stored in the pixels on the scanned scanning electrodes are discharged through a discharge path formed after that scanning is completed; and the data electrodes are brought to the high impedance state at the same time when the discharge path is formed.

10. A display device comprising:

a display panel having a luminescent layer, an array of scanning electrodes disposed on one surface of the luminescent layer and an array of data electrodes disposed on the other surface of the luminescent layer, the scanning electrodes perpendicularly crossing the data electrodes, capacitive pixels being formed at each intersection of both electrodes together with the luminescent layer, the pixels being arranged in a matrix;

a scanning electrode driving circuit for supplying scanning voltages to the scanning electrodes, scanning being performed in a positive field and a negative field, polarities of the scanning voltages being alternated field by field; and a data electrode driving circuit for supplying data voltages to the data electrodes, wherein:

the scanning electrodes are sequentially scanned by sequentially supplying the scanning voltages thereto;

composite voltages consisting of the scanning voltages and the data voltages are imposed on the pixels thereby to activate the pixels to emit light;

the data electrode driving circuit supplies either a modulation voltage or a ground voltage as the data voltages to the data electrodes;

the scanning electrode driving circuit sets a base voltage to the same level as the modulation voltage Vm in the positive field and supplies a positive scanning voltage Vr to the scanning electrode to be scanned, and the scanning electrode driving circuit sets a base voltage to a level of a ground voltage Vg in the negative field and supplies a negative scanning voltage −(Vr−Vm) to the scanning electrode to be scanned;

the scanning electrode driving circuit forms a discharge path through which charges stored in the pixels on the scanning electrode once scanned are discharged after scanning of that scanning electrode is completed; and the data electrode driving circuit brings a voltage level of the data electrodes to a high impedance state at the same time when the discharge path is formed thereby to charge the pixels on the scanning electrodes not scanned.

11. A display device comprising:

a display panel having a luminescent layer, an array of scanning electrodes disposed on one surface of the luminescent layer and an array of data electrodes disposed on the other surface of the luminescent layer, the scanning electrodes perpendicularly crossing the data electrodes, capacitive pixels being formed at each intersection of both electrodes together with the luminescent layer, the pixels being arranged in a matrix;

a scanning electrode driving circuit for supplying scanning voltages to the scanning electrodes, scanning being performed in a positive field and a negative field, polarities of the scanning voltages being alternated field by field; and a data electrode driving circuit for supplying data voltages to the data electrodes, wherein:

the scanning electrodes are sequentially scanned by sequentially supplying the scanning voltages thereto;

composite voltages consisting of the scanning voltages and the data voltages are imposed on the pixels thereby to activate the pixels to emit light;

the data electrode driving circuit supplies either a modulation voltage or a ground voltage as the data voltages to the data electrodes;

the scanning electrode driving circuit sets a base voltage to the same level as the modulation voltage Vm in the positive field and supplies a positive scanning voltage Vr to the scanning electrode to be scanned, and the scanning electrode driving circuit sets a base voltage to a level of a ground voltage Vg in the negative field and supplies a negative scanning voltage −(Vr−Vm) to the scanning electrode to be scanned;

charges stored in the pixels on the scanning electrode once scanned are discharged through a path formed in the scanning and data electrode driving circuits; and the data electrode driving circuit brings a voltage level of the data electrodes to the ground voltage Vg in the positive field and to the modulation voltage Vm in the negative field, thereby charging the discharged pixels on the scanning electrode once scanned with the modulation voltage Vm.

* * * * *